United States Patent [19]

Hayashi

[11] 4,445,670

[45] May 1, 1984

[54] APPARATUS FOR CONTROLLING A PRESSURE-TYPE FURNACE FOR POURING MOLTEN ORES

[75] Inventor: Shizuo Hayashi, Suzuka, Japan

[73] Assignee: Fuji Electric Company, Ltd., Japan

[21] Appl. No.: 345,223

[22] Filed: Feb. 3, 1982

[30] Foreign Application Priority Data

Feb. 24, 1981 [JP] Japan ..... 56-26276

[51] Int. Cl.[3] ..... B22D 39/00

[52] U.S. Cl. ..... 266/80; 222/595; 222/590; 266/91

[58] Field of Search ..... 266/80, 89, 90, 91–94; 222/590, 595

[56] References Cited

U.S. PATENT DOCUMENTS 3,412,899 11/1968 Sutter ..... 222/595

3,998,365 12/1976 Lethen et al. ..... 222/590

*Primary Examiner*—L. Dewayne Rutledge

*Assistant Examiner*—Christopher W. Brody

*Attorney, Agent, or Firm*—Brumbaugh, Graves, Donohue & Raymond

[57] ABSTRACT

A method and apparatus for controlling the pouring of molten metals in a pressure-type furnace is provided. The furnace includes a reservoir for storing the molten metal, a first passage for supplying the metal to the reservoir, and a second passage for supplying the metal stored in the reservoir to a pouring chamber where they are poured into a mold. A gas having a predetermined pressure is supplied to a pressure chamber disposed above the reservoir. An output signal from a load cell is generated representative of the amount of the metal contained in the furnace. The output signals are processed in a sampling circuit to obtain a rate of variation signal representative of variations in the amount of the metal stored in the furnace. The rate of variation signal is compared in a comparator circuit with a reference value to generate a replenishment signal indicating that the molten metal is being replenished. Excessive gas supplied to the pressure chamber is released in response to the replenishment signal so that the molten metal is poured evenly as the metal is replenished.

3 Claims, 3 Drawing Figures

APPARATUS FOR CONTROLLING A PRESSURE-TYPE FURNACE FOR POURING MOLTEN ORES

BACKGROUND OF THE INVENTION

The present invention relates to a control method and apparatus for a pressure-type furnace for pouring molten metal.

A conventional pressure-type furnace for pouring molten metal is provided with a main body, a reservoir adapted to store the molten metal, an inlet passage through which the molten metal are supplied to the reservoir, and an outlet passage through which the molten metal in the reservoir is supplied to a molten metal pouring chamber. The passages are coupled to lower portions of the reservoir. A gas with a predetermined pressure is supplied to a pressure chamber disposed above the molten metal in the reservoir. The pressure of the gas forces a flow of molten metal through the outlet passage and thereby elevates the level of the metal in the pouring chamber. This level determines the rate at which the metal is poured through an opening in the pouring chamber into a mold.

The pressurized gas is supplied from a pressure supply to the pressure chamber and is controlled by a pressure control device to regulate the level in the pouring chamber and thereby the rate at which the molten metal are poured into the mold. In order to maintain a desired rate of pouring it is necessary to control the value of the gas pressure P in the pressure chamber in accordance with the amount of molten metal in the furnace. The gas pressure should maintain the level of the molten metal in the supply chamber at a constant level. Pressurized air is supplied to the pressure chamber momentarily to increase the pressure and thereby increase the level of the molten metal in the pouring chamber to pour the metal into the mold.

In a pressure-type furnace as described above, when the molten metal stored in the pouring chamber is poured into the mold at the same time that the metal are being replenished, the pressure in the reservoir increases as the amount of the molten metal in the reservoir increases. Consequently, the level of the metal in the pouring chamber increases. This results in variations in the amount of the metal poured in one operation. In order to prevent the variations, a solenoid valve is energized to an on-state to release an amount of air in the pressure chamber when the metal are poured into the mold during replenishment. As a result, excess air in the pressure chamber is exhausted so as to maintain the level of the molten metal in the pouring chamber at the proper level.

In order to accomplish the above-mentioned control operation, it is necessary to detect whether or not the molten metal are being replenished. A variety of methods for detecting this condition of the furnace have been proposed. One conventional detecting method includes the steps of: detecting the weight of molten metal in a furnace by means of a load cell disposed below the main body of the furnace; comparing an output signal of the load cell with an output signal of a potentiometer to obtain a signal representative of the fact that the molten metal are being replenished; and applying the signal indicating the metal are being replenished to a servo motor which drives a booster relay to control the pressure in the pressure chamber.

According to the above-described conventional method, however, a time delay in detecting replenishment may occur due to the presence of the servo motor and the potentiometer. In general, the replenishment of the molten metal is carried out very quickly, as, for example, by the use of a ladle or the like. Accordingly, a problem arises since the gas in the pressure chamber cannot be exhausted quickly enough to eliminate undesired pressure increases. It is thus difficult to control the amount of the metal poured at a desired rate with high accuracy due to the undesired increase in the pressure in the pressure chamber.

Another method of detecting the replenishment of the metal has been proposed in which the difference between the pressure of a pressure control device and the pressure in the pressure chamber is detected by means of a fine pressure difference detector, thereby indicating the replenishment of the metal. In this case, however, as in the abovedescribed method, a problem arises since a time delay in an operation of the detector also occurs, making it difficult evenly to control the pouring of the metal.

In addition, since both of the aforementioned detecting methods utilize complex mechanisms, they have short operating lives and have a relatively large down time when maintenance is required.

SUMMARY OF THE INVENTION

Accordingly, the present invention is designed to eliminate the drawbacks associated with the prior art methods. An object of the present invention is to provide a method for controlling the pouring of molten metal with high accuracy while the molten metal is being replenished. The above object of the invention is accomplished by a control method which includes the steps of sampling an output signal of a load cell which detects the amount of molten metal in a furnace; detecting the rate of variations in the amount of the molten metal; determining that the molten metal are being replenished when the variation rate derived from the load cell exceeds a reference value; and releasing air contained in a reservoir so that the metal are evenly poured.

A pressure-type furnace for pouring molten metal includes a reservoir for storing the molten metal, an inlet passage for replenishing the molten metal, and an outlet passage for pouring out the molten metal. An air pressure chamber is disposed above the reservoir for adjusting the level of the metal. A source of air pressure supplies pressurized gas to the air pressure chamber. Means are coupled to the air pressure source for controlling the supply of the pressurized gas to the air pressure chamber. A load cell is placed under the furnace and generates signals representative of the amount of molten metal in the furnace. A circuit responsive to the load cell signals generates signals representative of the rate of variation in the amount of the molten metal in the furnace. A comparator responsive to a reference signal and the variation signals generates signals to operate the air pressure controlling means when the variation signals exceed the reference signal so that the molten metal are evenly poured when the metal are replenished.

DETAILED DESCRIPTION

Figure 1:
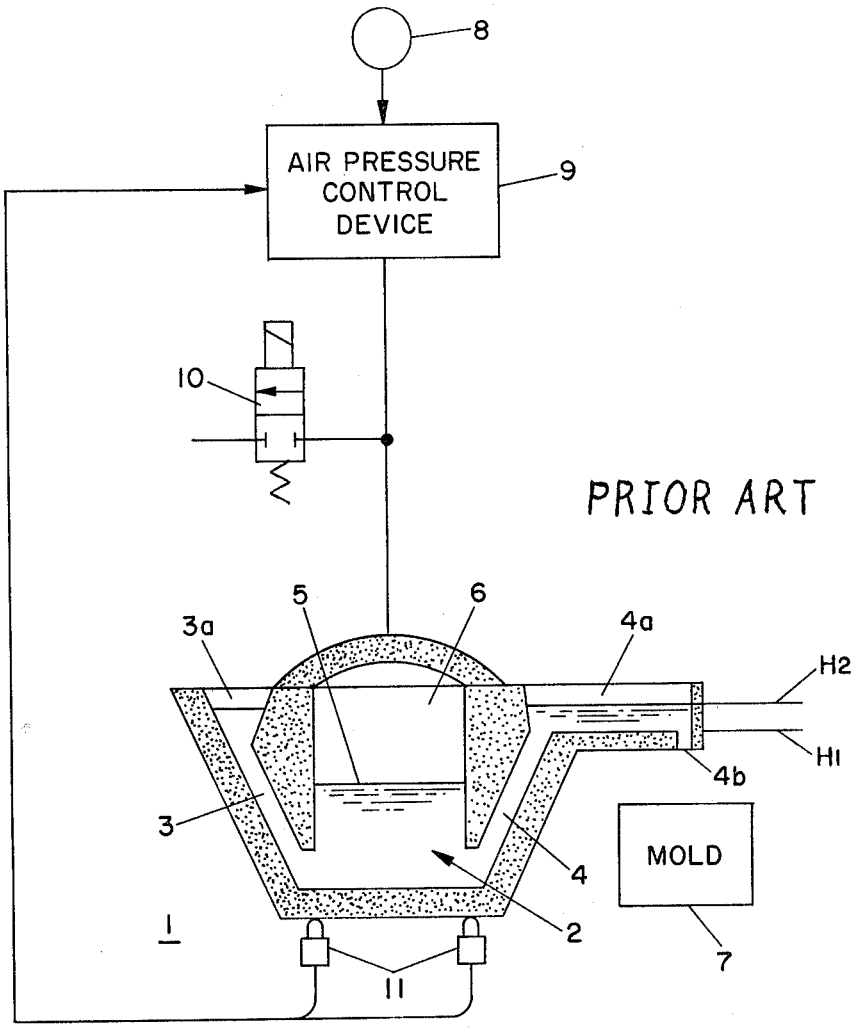
FIG. 1 is a schematic diagram showing a conventional pressure type furnace for pouring molten metal.

As shown in FIG. 1, a main body 1 of a conventional pressure type furnace for pouring molten metal 5 is provided with a reservoir 2 adapted to store the metal 5. An inlet passage 3 supplies the metal 5 from an opening 3*a* to the reservoir 2. An outlet passage 4 supplies the molten metal 5 stored in the reservoir 2 to a pouring chamber 4*a*. The passages 3 and 4 are coupled to lower portions of the reservoir 2. A gas having a predetermined pressure is supplied to a pressure chamber 6 disposed above the metal 5 to elevate the metal 5 through the outlet passages 4 to the pouring chamber 4*a*. The metal 5 is then poured through an opening 4*b* into a mold 7.

A pressurized gas supplied from a pressure supply 8 to the pressure chamber 6 is controlled by a pressure control device 9 to pour a predetermined amount of the metal 5 into the mold 7. The pressure in the pressure chamber 6 equals a pressure P and corresponds to an amount of metal detected by a load cell 11. The level of the metal 5 in the pouring chamber 4*a* is accordingly maintained at a predetermined level $H_1$. The ores 5 are poured into the mold 7 by increasing momentarily the pressure of the air in the pressure chamber 6 by an amount $\Delta P$ so as to shift the level of the metal 5 to a level $H_2$.

When the metal 5 in the pouring chamber 4*a* is poured into the mold 7 simultaneously with the replenishment of the metal from the opening 3*a*, the pressure in the chamber 6 above the reservoir 2 increases as the amount of the metal 5 in the reservoir 2 increases. The level of the metal in the pouring chamber 4*a* accordingly increases. This results in variations in the amount of the metal poured in one pouring operation. In order to prevent variations, a solenoid valve 10 is energized to an on-state when the metal 5 is poured into the mold 7 during replenishment. An amount of the air in the pressure chamber 6, corresponding to an incremental increase in the amount of the metal 5 in the reservoir 2, is released to maintain the level of the metal in the pouring chamber 4*a* at the level $H_2$.

Figure 3:
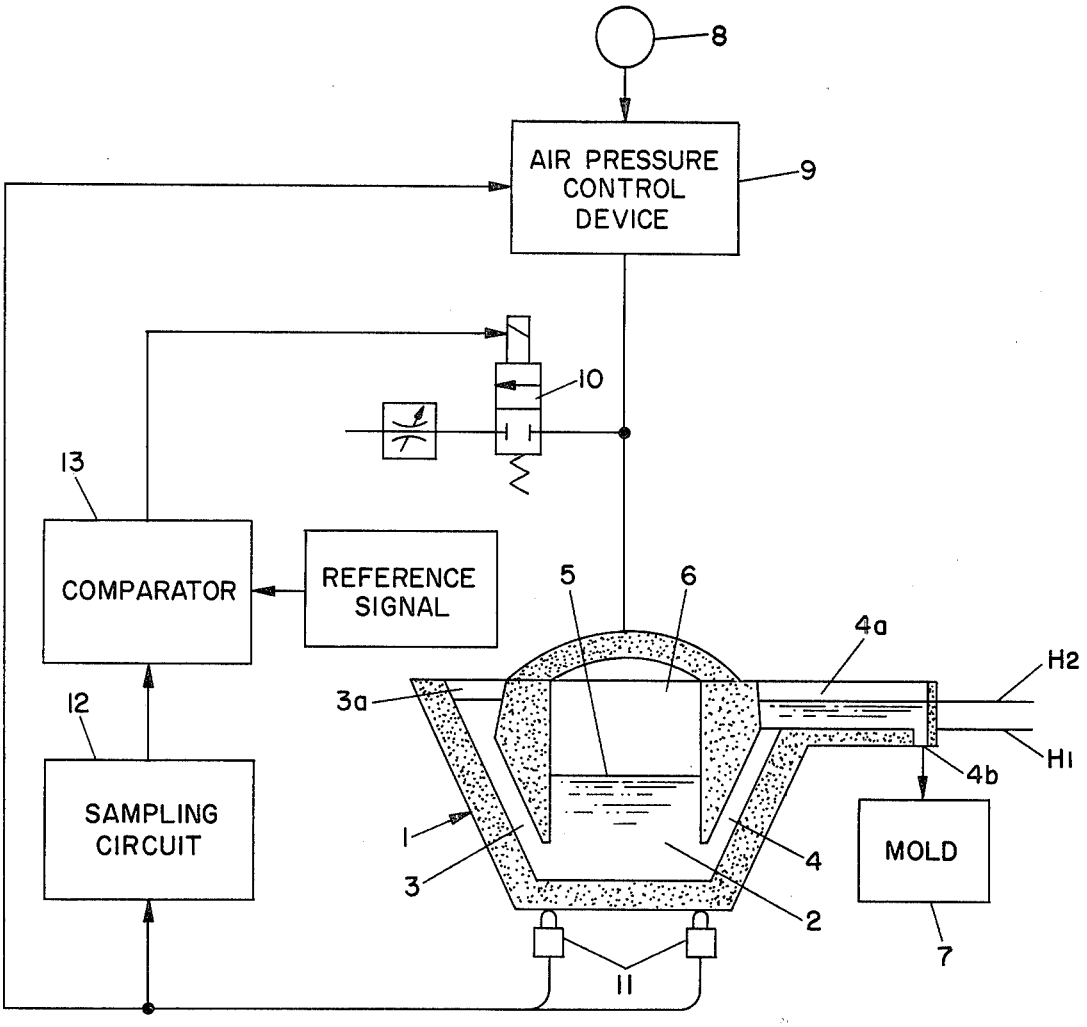
FIG. 3 is a schematic diagram showing a preferred embodiment of a pressure-type furnace in accord with the present invention.

Note that, in the embodiment shown in FIG. 3, parts and elements that are common to those shown in FIG. 1 bear the same reference numerals and operate in the same manner.

In FIG. 3, the main body 1 of the furnace is disposed on the load cell 11. The load cell 11 produces an output signal representative of the weight of the metal 5 stored in the furnace.

The output signal of the load cell 11, that is, the weight of metal in the furnace, is sampled by a sampling circuit 12 at a predetermined time interval. The predetermined time interval can range from 0.5 to 2 seconds, for instance. In the sampling circuit 12, a difference between a sampling value sampled in the preceding sampling step and that sampled in the present sampling step is calculated. A rate of variation in the weight of the metal 5 stored in the furnace 1 is thus detected.

Figure 2:
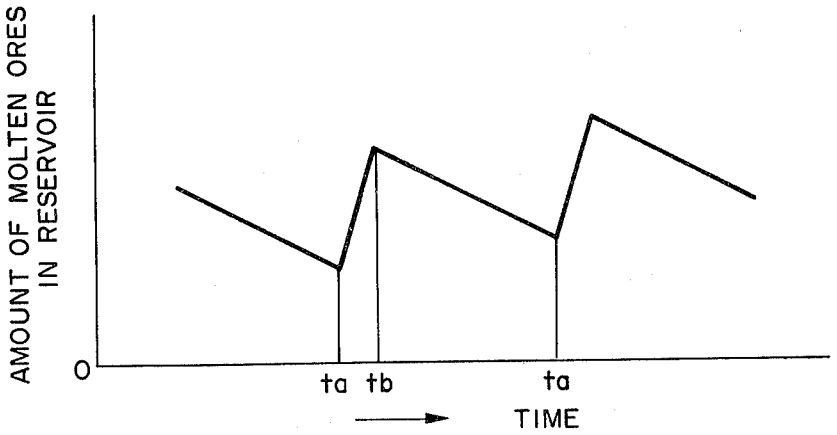
FIG. 2 is a graphical representation showing a variation in a weight of molten metal in the furnace with time on the horizontal axis and the amount of the molten metal in the reservoir on the vertical axis.

Upon replenishment of the metal, the weight of the metal in the furnace abruptly increases in a short period of time Ta to Tb, as shown in FIG. 2. A variation in the weight of the metal in the furnace when the metal are poured is shown as a period of time Tb to Ta in FIG. 2.

A signal from the sampling circuit 12 representative of the rate of variation in the weight of the metal is then compared with a constant reference signal in a comparator circuit 13. When the variation rate exceeds a reference value, e.g., 10 to 30 Kg/sec., the comparator circuit 13 produces an output signal. As a result, the replenishment of the metal is detected and the solenoid valve 10 is actuated to release excessive gas.

During the replenishment of the metal, air having a predetermined air pressure P is continuously supplied from the pressure control device 9, so that the inner pressure of the pressure chamber 6 is always maintained at P and the level of the metal in the pouring chamber 4*a* is maintained at $H_1$. When the metal are poured, on the other hand, the inner pressure in the pressure chamber 6 is increased to $P+\Delta P$ to increase the level of the metal in the pouring chamber 4*a* to the level indicated by $H_2$.

When the pouring operation is performed during replenishment, the comparator circuit 13 produces an output in response to the replenishment to actuate the solenoid valve 10. A specified amount of the air in the pressure chamber 6 is accordingly exhausted to keep the level of the metal at the level $H_2$.

Figure 4:
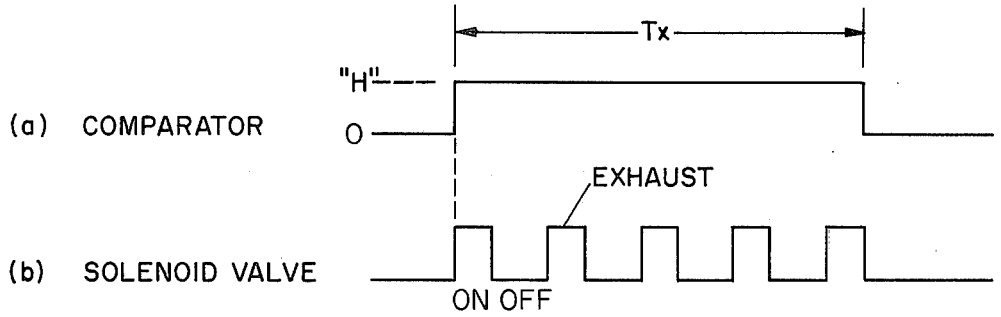
FIG. 4 is a graphical representation showing an exhaust operation, with time on the horizontal axis and the amount of exhausted air on the vertical axis.

The solenoid valve 10 is repeatedly turned on and off during a replenishment period of time Tx, as shown in FIG. 4(*b*), so that the required amount of air is released. The ratio of the duration of the on-state to that of the off-state is adjustable, and can be selected to be an optimum rate in accordance with such conditions as the capacity of the valve 10, the replenishment speed or the like.

Accordingly, even if the metal in the pouring chamber 4*a* is poured into the mold 7 while the metal are being replenished, the molten metal level in the pouring chamber 4*a* can be maintained at the constant level of $H_2$ since the inner pressure in the pressure chamber 6 can be maintained at the predetermined value according to the above-described exhaust operation. Therefore, an amount of metal for one pouring operation is always controlled accurately.

As described above, according to the present invention, the detection of the replenishment is carried out by way of a simple signal processing, such as a sampling operation, of the output of a load cell. The detection speed is extremely high and any time delay until an exhaust operation starts is effectively eliminated. Hence, the amount of metal poured can be controlled with high accuracy even when the metal are being replenished.

Further, since no movable mechanisms such as a potentiometer, a servo motor or the like are needed, a long service life can be obtained and maintenance is easier than in the prior art mechanisms.

While one embodiment of the present invention has been described in detail herein and shown in the accompanying drawings, it will be evident that various further modifications are possible without departing from the spirit and scope of the invention.

I claim:

1. A pressure-type furnace for pouring molten metal comprising:

a reservoir for storing said molten metal;

an inlet passage in fluid communication with said reservoir for replenishing said molten metal;

an outlet passage in fluid communication with said reservoir for pouring said molten metal;

an air pressure chamber disposed above said reservoir for adjusting the level of said metal in said reservoir;

a source of air pressure for supplying pressurized gas to said air pressure chamber;

means coupled to said air pressure source for controlling the supply of said pressurized gas to said air pressure chamber;

a load cell and a sampling circuit means for intermittently generating signals which are successively representative of the instantaneous amount of molten metal in said furnace;

circuit means responsive to differences between said successive signals for generating signals representative of the rate of variation in the amount of said molten metal in said furnace;

means for generating a reference signal representative of a specified rate of variation in the level of molten metal in said furnace;

solenoid valve means for controlling the release of air from the pressure chamber; and comparator means responsive to said reference signal and said rate of variation signals for generating signals to operate said solenoid valve means when said rate of variation signals exceed said reference signal so that said molten metal is evenly poured when said metal is replenished.

2. The furnace of claim 1 wherein said circuit means comprises a sampling circuit for sampling said load cell signals at a predetermined interval.

3. The furnace of claim 2 wherein said interval is from about ½ second to about 2 seconds.

* * * * *